United States Patent [19]

Huh et al.

[11] Patent Number: 4,980,050

[45] Date of Patent: Dec. 25, 1990

[54] CATALYTIC CRACKING PROCESS WITH PARTIAL CO COMBUSTION

[75] Inventors: Billy K. Huh, Lawrenceville, N.J.; Tsoung Y. Yan, Philadelphia, Pa.

[73] Assignee: Mobil Oil Corporation, Fairfax, Va.

[21] Appl. No.: 206,241

[22] Filed: Jun. 10, 1988

[51] Int. Cl.[5] ..... C10G 11/00; C01B 17/60; B01J 20/02

[52] U.S. Cl. ..... 208/113; 208/251 R; 502/406

[58] Field of Search ..... 208/113, 126, 124, 127, 208/298, 299, 300, 307, 120, 251 R; 502/406

[56] References Cited

U.S. PATENT DOCUMENTS

| | | | |
|---|---|---|---|
| 2,742,403 | 4/1956 | Nicholson et al. | 196/49 |
| 4,071,070 | 1/1978 | Schmidt . | |
| 4,071,436 | 1/1978 | Blanton, Jr. et al. . | |
| 4,284,494 | 8/1971 | Bartholic et al. | 208/113 X |
| 4,289,608 | 9/1981 | McArthur | 208/121 |
| 4,469,588 | 9/1984 | Hettinger, Jr. et al. | 208/251 R |
| 4,469,589 | 3/1982 | Flossmoor et al. . | |
| 4,529,502 | 7/1985 | Wang | 208/113 |
| 4,642,177 | 2/1987 | Mester et al. | 208/113 |
| 4,686,204 | 8/1987 | Mester et al. | 502/406 |

*Primary Examiner*—Glenn Caldarola
*Attorney, Agent, or Firm*—Alexander J. McKillop; Charles J. Speciale; Richard D. Stone

[57] ABSTRACT

A catalytic cracking process for converting heavy, metals laden feed to lighter products is disclosed. The catalyst regenerator is operated under relatively reducing conditions, to produce a flue gas containing at least 1 mole % carbon monoxide. An additive, preferably alumina, is added to the circulating catalyst inventory to selectively sorb metal contaminants in the feed. The reducing conditions in the catalyst regenerator minimize formation of highly oxidized forms of vanadium, permitting higher vanadium levels to be tolerated on the cracking catalyst. The additive material has a greater affinity for vanadium than the cracking catalyst, and absorbs a disproportionate amount of metals in the feed. Preferably a soft, friable, alumina additive is used which results in the production of alumina fines rich in vanadium, which are discharged from the unit with catalyst fines. The process works especially well in fluidized catalytic cracking processes, with removal of vanadium laden alumina fines from the FCC regenerator with the regenerator flue gas.

20 Claims, 1 Drawing Sheet

CATALYTIC CRACKING PROCESS WITH PARTIAL CO COMBUSTION

BACKGROUND OF THE INVENTION

This invention is related to catalytic cracking of hydrocarbons. It more particularly refers to improvements in the endothermic catalytic cracking of petroleum fractions and alternative exothermic catalyst regeneration.

Endothermic catalytic cracking of hydrocarbons, particularly petroleum fractions, to lower molecular weight desirable products is well known. This process if practiced industrially in a cycling mode wherein hydrocarbon feedstock is contacted with hot, active, solid particulate catalyst without added hydrogen at rather low pressures of up to about 50 psig and temperatures sufficient to support the desired cracking. As the hydrocarbon feed is cracked to lower molecular weight, more valuable and desirable products, "coke" is deposited on the catalyst particles. The coked catalyst is disengaged from the hydrocarbon products, which are then separated into appropriate components. The coked catalyst particles, now cooled from the endothermic cracking and disengaged from the hydrocarbon products, are then contacted with an oxygen containing gas whereupon coke is burned off the particles to regenerate their catalytic activity. During regeneration, the catalyst particles absorb the major portion of the heat generated by the combustion of coke, i.e., they are "reflexively" heated, with consequent increase of catalyst temperature. The heated, regenerated catalyst particles are then contacted with additional hydrocarbon feed and the cycle repeats itself.

A flue gas comprising carbon oxides and, to a lesser extent, nitrogen oxides is produced during regeneration. The carbon monoxide and nitrogen oxides are sometime vented to the atmosphere with the rest of the flue gas. Alternatively, the carbon monoxide in some plants is burned to carbon dioxide, in a CO boiler to recover process steam and reduce emissions.

Two major variants for endothermically cracking hydrocarbons are fluid catalytic cracking (FCC) and moving bed catalytic cracking. In both of these processes as commercially practiced, the feed hydrocarbon and the catalyst are passed through a "reactor"; are disengaged; the catalyst is regenerated with cocurrent and/or countercurrent air; and the regenerated reflexively heated catalyst recontacted with more feed to start the cycle again. These two processes differ substantially in the size of the catalyst particles utilized in each and also in the engineering of materials contact and transfer which is at least partially a function of the catalyst size.

In fluid catalytic cracking (FCC), the catalyst is a fine powder of about 10 to 200 microns, preferably about 70 micron, size. This fine powder is generally propelled upwardly through a riser reaction zone suspended in and thoroughly mixed with hydrocarbon feed. The coked catalyst particles are separated from the cracked hydrocarbon products, and after purging are transferred into the regenerator where coke is burned to reactivate the catalyst. Regenerated catalyst generally flows downward from the regenerator to the base of the riser.

One typical example of industrially practiced moving bed hydrocarbon catalytic cracking is known as Thermofor Catalytic Crackig (TCC). In this process the catalyst is in the shape of beads or pellets having an average particle size of about 1/64 to ½ inch, preferably about ⅛ inch. Active, hot catalyst beads progress downwardly cocurrent with a hydrocarbon charge stock through a cracking reaction zone. In this zone hydrocarbon feed is endothermically cracked to lower molecular weight hydrocarbons while coke is deposited on the catalyst. At the lower end of the reaction zone the hydrocarbon products are separated from the coked catalyst, and recovered. The coked catalyst is then passed downwardly to a regeneration zone, into which air is fed such that part of the air passes upwardly countercurrent to the coked catalyst and part of the air passes downwardly cocurrent with partially regenerated catalyst. Two flue gases comprising carbon oxides are produced. Regenerated catalyst is disengaged from the flue gas and is then lifted, pneumatically or mechanically, back up to the top of the reaction zone.

The catalysts used in endothermic catalytic nonhydrogenative cracking are to be distinguished from catalysts used in exothermic catalytic hydrocracking. Operating conditions are also to be distinguished. While the catalytic cracking processes to which this invention is directed operate at low pressures near atmospheric and in the absence of added hydrogen, hydrocracking is operated with added hydrogen at high pressures of up to about 1000 to 3000 psig. Further, nonhydrogenative catalytic cracking is a reflexive process with catalyst cycling between cracking and regeneration (coke burn off) over a very short period of time, seconds or minutes. In hydrocracking, on the other hand, the catalyst remains in cracking service for an extended period of time, months, between regeneration (coke burn off). Another important difference is in the product. Nonhydrogenative catalytic cracking produces a highly unsaturated product with substantial quantities of olefins and aromatics, and a high octan gasoline fraction. Hydrocracking, in contrast, produces an essentially olefin-free product with a relatively low octane gasoline. This invention is not directed to hydrocracking nor is it within the scope of this invention to use hydrocracking catalysts in the process hereof.

The invention is directed to catalytic cracking units, such as the FCC processes shown in U.S. Pat. No. 3,904,548 (swirl type regeneration), U.S. Pat. No. 3,886,060 (catalytic cracking of resids), U.S. Pat. No. 4,654,060 (closed cyclones on riser reactor outlet). The teachings of all of these patents are incorporated by reference.

The invention uses conventional FCC catalysts. The last two decades have seen major developments in catalyst compositions for use in catalytic cracking. The catalysts formerly widely employed in FCC and TCC have included acid treated clays, amorphous silica-alumina composites and the like. Many variants, such as silica-zirconia, silica-magnesia and other acidic porous solids have been described in the literature The first major development provided much more effective catalysts by blending a major portion of the older amorphous catalysts with a minor portion of an active crystalline aluminosilicate zeolite. Catalysts of this type for FCC and TCC are described in U.S. Pat. Nos. 3,140,249 and 3,140,253, which are hereby incorporated by reference.

Another major development was CO combustion in the regenerator. Many FCC units now operate with trace amounts of a platinum group metal, such as 1.0 parts ppm Pt, incorporated with the cracking catalyst. The Pt catalyzes the complete burning of carbon monoxide to carbon dioxide in the regenerator without detriment to the cracking reaction. This development has been very widely accepted by refiners. Such catalysts and their use are described in U.S. Pat. Nos. 4,251,395; 4,265,787; 4,088,568; 4,072,600; 4,093,535 and 4,159,239; all to Schwartz, are incorporated herein by reference. Such promoted catalysts may be used to completely burn CO (referred to hereinbelow as "full CO combustion") or to only partially burn the CO (referred to hereinbelow as "partial CO-combustion") by the simple expedient of limiting the oxygen supplied to the regenerator. The term "Pt group metal CO-oxidation promoter" as used herein means those metals and their mode of use as taught by the Schwartz patents cited above. Full CO combustion exacerbates some pre-existing problems (metal contamination) and creates some new problems ($NO_x$, $SO_x$ emissions). The more active zeolite catalysts allowed refiners to process heavier charge stocks, and include minor amounts of resid in the feed. Metals levels on catalyst increased.

METALS CONTAMINATION

Cracking catalysts have always been adversely affected by metals such as nickel and vanadium contained in the feed. The problem is aggravated by the trend towards processing heavier feeds and towards including some residual oil along with gas oil, both of which increase the rate of metals accumulation on the catalyst and detract from gasoline and alkylate selectivity. Nickel deposits on the catalyst hurt conversion and $C_{5+}$ gasoline selectivity primarily by increasing coke make and hydrogen production due to nickel's inherent dehydrogenation activity. In addition to dehydrogenation activity, recent studies have shown that vanadium deposits on cracking catalyst lead to premature loss of crystallinity, probably due to the formation of vanadic acid during regeneration. (See, for example, Speronello et al., Oil and Gas Journal, Jul. 6, 1981, page 103.)

Metals passivation processes, where antimony is added to the unit, passivate the hydrogenation activity, but leave the metal on the catalyst. Vanadic acid can still form and attack the zeolite structure. Some refiners are reluctant to add antimony (which is a poison) to their cracking units.

NITROGEN OXIDES

A further problem encountered by the refiner arises from increased environmental constraints on emission of nitrogen oxides ($NO_x$) contained in the flue gas. Operation with CO-combustion promoters, which solves the CO emissions problem, can in some instances increase the $NO_x$ emissions. Heavy feeds also tend to have more $NO_x$ precursors, i.e., the feeds produce a coke which contains more nitrogenous compound, which burn in the regenerator to form $NO_X$.

SULFUR OXIDES $SO_x$ emissions are also a problem, especially so when complete CO combustion is practiced. Some $SO_x$ was always formed, but the excess oxygen essential for full CO combustion increased $SO_x$ formation. This could be dealt with by making the regenerator even more oxidizing, and adding an $SO_x$ acceptor to the catalyst.

It is well known to add alumina and spinel materials to the circulating catalyst inventory in an FCC unit to adsorb or react with $SO_x$ formed in the FCC regenerator. By operating the FCC regenerator with excess oxygen, at very high temperatures, it is possible to completely afterburn essentially all of the carbon monoxide produced by coke combustion into $CO_2$. In these oxidizing environments, the alumina and spinnel additives react with or adsorb $SO_x$, and release it in the reducing atmosphere and countered in the riser reactor zone as $H_2S$. The alumina preferred for such service are those with fluidization characteristics compatible with FCC catalyst. The alumina is usually added as a separate additive, because the alumina which is present on conventional FCC catalyst (usually as part of the matrix) is not effective for adsorbing $SO_x$. The separate alumina additive is usually selected to be one which is a strong, relatively dense material, so that it will not be prematurely lost from the unit.

U.S. Pat. No. 4,071,436 is directed to removing $SO_x$ from FCC regenerator flue gas with alumina. U.S. Pat. Nos. 4,471,070 and 4,469,589, among others, are directed to forming and using aluminum containing spinels in the regenerator. All of these are incorporated by reference.

When heavy, metals laden resid feeds are added to FCC units, the problems cascade. The regenerator gets hotter, because of the increased coking associated with heavy feeds. $SO_x$ and $NO_x$ emissions increase with dirtier feeds and hotter regenerator operation. Vanadium levels increase. Much of the increase is noted in the pentavalent form, which is formed slowly in the oxidizing atmosphere of a completely CO combusting regenerator. Vanadic acid forms, and this attacks the zeolite structure in the cracking catalysts.

We have now discovered a way to efficiently manage the metals contamination problem encountered when processing heavy, vanadium contaminated feedstocks.

We discovered that adding a relatively high surface area alumina additive permits efficient capture of vanadium in the feed. We have further found that operating the FCC regenerator in partial combustion mode minimizes the oxidation of deposited vanadium to the pentavalent form.

Our process does two things:

(1) Most of the vanadium is captured by an efficient metal scavenging additive before it is deposited on the catalyst;

(2) The vanadium which escapes capture and deposits on catalyst is maintained in a generally lower oxidation state, so that significantly higher vanadium levels can be tolerated on the zeolite catalyst before there is an unacceptable loss of zeolite crystallinity.

When using the preferred alumina additive (relatively high surface area, soft, relatively large particle size) the vanadium is continuously removed from the unit with the regenerator flue gas. This can be achieved because the large, soft particles of alumina additive will spend most of their time in the FCC unit in the FCC regenerator. Due to the constant agitation experienced in fluidized beds, the edges of the alumina additive will be constantly abraded, and removed from the unit wherever they happen to be at the time the abrasion occurs. As the catalyst, and additive, will spend approximately 60–90 percent of the time in the FCC regenerator, a majority of the vanadium deposited on the feed can be efficiently removed as fines in the regenerator flue gas.

BRIEF SUMMARY OF THE INVENTION

Accordingly the present invention provides in a catalytic cracking process for cracking of hydrocarbons by contacting hot solid zeolite cracking catalyst and crackable hydrocarbon feed containing vanadium in a cracking zone, cracking the feed to lighter hydrocarbons while depositing coke and vanadium on the catalyst, disengaging coked catalyst from lighter hydrocarbons, passing coked catalyst to a regenerator zone and contacting coked catalyst to burn coke off the catalyst and produce hot, regenerated catalyst, and a flue gas comprising carbon oxides, and returning the regenerated catalyst to the cracking zone; the improvement which comprises adding to the cracking catalyst about 0.1 to 10 wt. % of separate particles of a solid additive material which has more affinity for vanadium than the zeolite cracking catalyst; and limiting the flow of oxygen containing gas to the regenerator to maintain at least 1.0 mole % CO in the flue gas.

In another embodiment the present invention provides in a catalytic cracking process for cracking of hydrocarbons by contacting hot solid zeolite cracking catalyst and crackable hydrocarbon feed containing vanadium in a cracking zone, cracking the feed to lighter hydrocarbons while depositing coke and vanadium on the catalyst, disengaging coked catalyst from lighter hydrocarbons, passing coked catalyst to a regenerator and contacting coked catalyst with an oxygen containing gas to burn coke off the catalyst and produce hot, regenerated catalyst and flue gas comprising carbon oxides, and returning the regenerated catalyst to the cracking zone; the improvement which comprises limiting the flow of oxygen containing gas to the regenerator to maintain at least 1.0 mole % CO in the flue gas; adding 0.1 to 10 wt. % alumina additive having a vanadium selectivity, Kv, of at least 10, based on the total weight of catalyst and additive in the cracking unit; removing at least 10% per day of the alumina additive from the cracking unit as fines, the fines containing at least an order of magnitude more vanadium than the equilibrium catalyst in the unit.

BRIEF DESCRIPTION OF THE DRAWING

The single figure is a simplified, schematic view of an FCC unit of the present invention.

DETAILED DESCRIPTION

Figure 1:
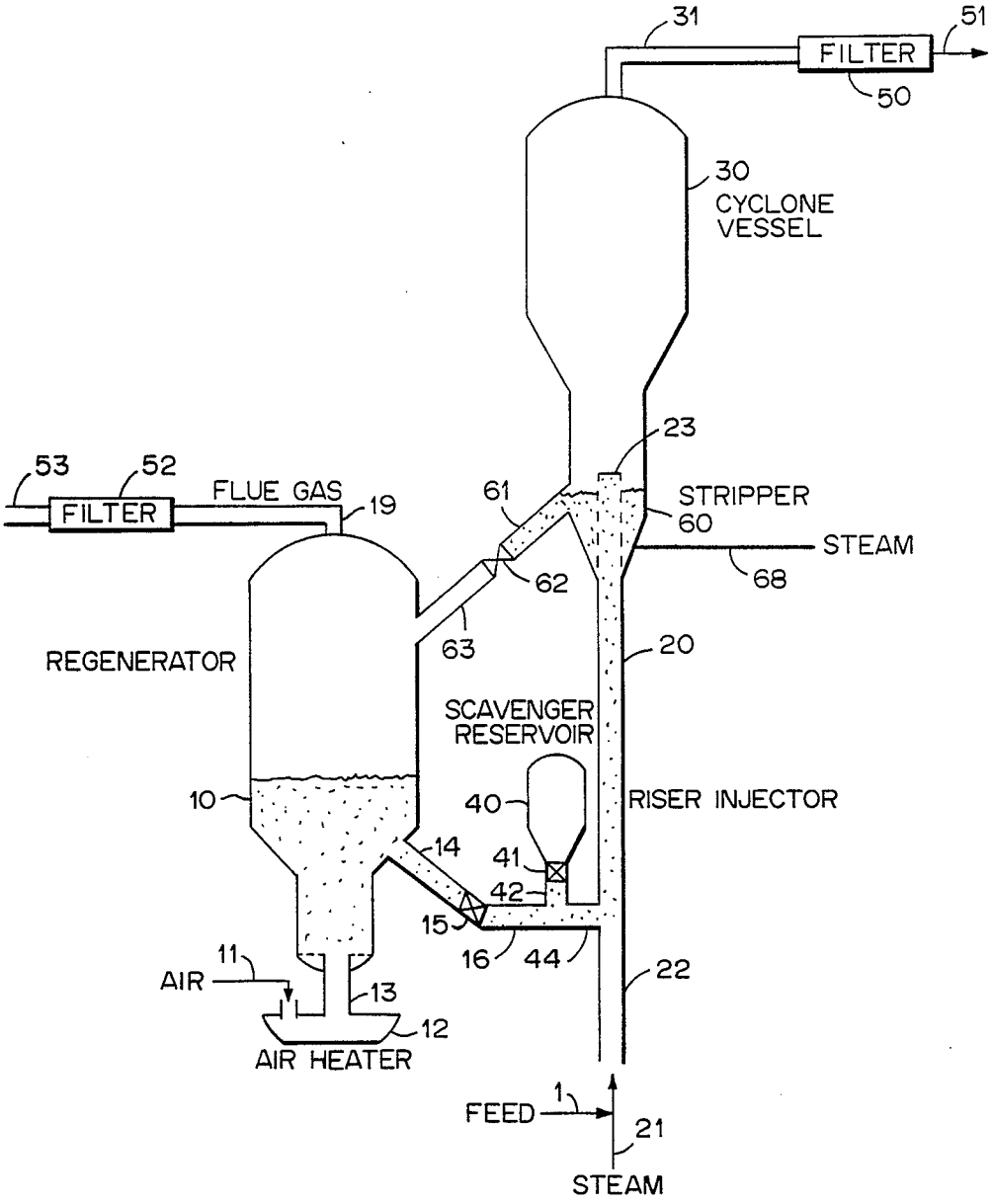

The invention can be better understood with reference to the attached Figure which shows one embodiment of the invention.

Heavy, vanadium contaminated feed in line 1 is mixed with steam from line 21 and charged to the base 22 of riser 20. Hot regenerated catalyst is added to the lower portion of the riser via line 16. Hot regenerated catalyst cracks the feed. Cracked products, and resulting coked catalyst exit the riser at outlet 23. It is conventional to augment the separation of cracked products from coked catalyst by providing cyclones at the riser 23 outlet, or one or more stages of cyclone separation within cyclone vessel 30, but these conventional details are not shown in the drawing. Cracked products are removed via line 31.

Coked catalyst collects as a dense bed in stripper 60 located below the riser outlet. Stripping steam added via line 68 removes strippable hydrocarbons from the coked catalyst. The stripped catalyst is removed via line 61 valve 62 and line 63 and charged into regenerator 10. Regeneration air passes through air heater 12 (usually used only for start up) and line 13 into the base of regenerator 10. The air burns coke from the catalyst and regenerates it. Hot regenerated catalyst is withdrawn via line 14, valve 15 and line 16 and recycled to the base section 22 of riser 20 to crack more fresh feed.

A scavenger reservoir 40 is shown in the drawing. This is a very efficient place to add the vanadium getter additive, but not the only place. The vanadium getter additive will mix with the hot regenerated catalyst to some extent in the length of pipe 44 which connects with the base of riser 20. The scavenger will remove much of the vanadium content of the fresh feed, and may itself be promptly removed from the unit. Much of the vanadium scavenger can be removed with the cracked products. Filter 50 removes catalyst fines and vanadium getter additive from cracked product which is discharged via line 51 to conventional downstream processing operations. Getter additive not removed with the cracked product will pass with the spent, coked catalyst through the stripper 60 and into regenerator 10. Some of the vanadium getter additive will have a sufficiently small size, and/or low enough density, that it will be carried out in the flue gas 19 and charged to filter 52 which will remove vanadium getter additive and catalyst fines. Flue gas with a reduced fine content is discharged via line 53. Much of the vanadium getter additive present in the regenerator will have settling/-fluidizing characteristics that make it behave very similarly to the conventional cracking catalyst. The getter additive will abrade and attrit in the regenerator and create fines which will contain extremely high levels of vanadium, ranging from 10 to 100 or move times as much vanadium as is present on the equilibrium catalyst in the unit. These vanadium getter fines, created in situ in the regenerator, are discharged with the regenerator flue gas. A minor portion of vanadium getter fines created in the regenerator are carried into the reactor section with the catalyst, but these fines will then be removed either with cracked products in line 31 or with flue gas in line 19. The vanadium getter additive also abrades and attrits in the riser reactor to create additional fines which are recovered either with the cracked product or with the flue gas, as previously discussed.

Although not shown in the drawing, the invention can also be practiced in moving bed or Thermofor catalytic cracking (TCC) units. In Thermofor catalytic cracking it will usually be preferred to add fairly large particles of alumina, which will slowly abrade and attrit as the catalyst circulates through the unit. Vanadium laden additive fines, created in situ during circulation, will be removed from the unit the same way that catalyst fines are presently removed from TCC cracking units. To aid in fines generation/removal, a slipstream of the circulating catalyst inventory can be removed and subjected to conventional shaking and screening treatments to both create fines and remove catalyst and vanadium getter additive fines.

FEED

The feed to the process of this invention may be any conventional petroleum fraction suitable for cracking to gasoline and fuel oil, and it may include, as a portion or all of the feed, fractions that are more heavily contaminated with metals than those in common usage. Preferred feeds are heavy crudes and resids containing more than 100 ppm V.

CRACKING CATALYST

In FCC, the catalyst may be any fluidizable zeolitic cracking catalyst. Preferably, low coke making catalysts which are selective for gasoline and fuel oil, are used. This allows the high coke make associated with the resid feed to be more readily tolerated and burned in the regenerator. An analogous bead material may be used in TCC.

REGENERATOR CONDITIONS

It is essential that a generally reducing atmosphere be maintained in the regenerator used herein. By the term "generally reducing atmosphere" is meant that at least 1.0 mole % of the flue gas leaving the FCC unit is carbon monoxide. Preferably the CO content of the flue gas is 4–10% or even higher.

These generally reducing conditions mean that the use of a downstream CO boiler, or other equivalent means, may be necessary to meet local air quality standards. The reducing conditions will also minimize $NO_x$ emissions.

The reducing conditions which are essential for use herein will also seriously degrade, and perhaps eliminate, the effectiveness of the alumina additive for $SO_x$ control.

Thus the present invention solves almost completely the problem of vanadium contamination on the catalyst, but does not address the problems of CO combustion nor $SO_x$ emissions from an FCC regenerator.

These drawbacks (CO, $SO_x$ emissions) are not that serious in practice. When attempts are made to add more resid to the FCC units, the units are frequently limited by coke burning capacity in the regenerator, or by $SO_x$ emissions.

Coke burning capacity can be limiting because all of the Conradson carbon and other coke producing materials deposited on the catalyst from the feed must be removed by combustion in the FCC regenerator. Heavier feeds produce more coke. There is a limit in most FCC units as to the amount of coke that can be burned. Many FCC units have, or can be easily modified to contain, CO combustion boilers. This allows much of the work of coke combustion to be shifted from the regenerator to the downstream CO boiler. Refiners can also add more oxygen to the flue gas and burn it in a power recovery system. The CO emissions are sometimes desirable from an FCC regenerator, especially so when the regenerator cannot cope with the heat release by complete combustion to $CO_2$ and even more so when there is a convenient use that can be made of the low BTU gas coming from the FCC regenerator.

$SO_x$ removal from FCC flue gas by use of alumina additives is a good way to reduce the $SO_x$ content but it may not be able to cope with the increased $SO_x$ emissions associated with charging heavier feeds. Alumina additive may also not be able to absorb or adsorb enough $SO_x$ to cope with the increasing strictness of local air quality regulations. Thus in many instances a stack gas scrubber may be needed to satisfy local air quality regulations. The cost of an $SO_x$ scrubber will not increase significantly because of a minor increase in $SO_x$ content of the regenerator flue gas.

HIGH AFFINITY ADDITIVE

Any additive which has a high affinity for vanadium can be used in the practice of the present invention. Suitable additives include alumina, coal, MgO, bauxite and similar materials. Alumina is preferred.

It is preferred to use an additive material that has a partition coefficient Kv, as hereafter defined, of at least 1.5, and preferably at least 10. Many of the dense, high strength alumina additives used heretofor for $SO_x$ control in FCC units can also be used herein. Although these conventional alumina additives work, they are not preferred. We prefer to use alumina with more surface area, lower density, and a somewhat larger particle size than found preferable in the prior art processes directed to $SO_x$ emission control. Preferred properties of the alumina are shown below:

Density=4 g/cc
Surface Area: 100–300 $m^2/g$
Particle Size: 100–250 microns
Pore Size: 100–200 Angstrom The inventive concept requires addition to the circulating inventory of zeolite cracking catalysts separate particles of a discrete additive, preferably alumina, the addition being effective to provide a steady state concentration of about 0.1 to about 10.0 weight percent of said particles in the cracking zone, with a preferred concentration of about 0.5 to 7.0 weight percent. In the cracking zone, a portion of the metals carried in with the fresh feed is deposited on the alumina additive serving to reduce the amount of said metals available for deposition on the catalyst. When the catalyst and alumina additive pass through the regeneration zone, the coke on the catalyst and the alumina additive is burned off. Since the metals, such as nickel and vanadium, which are deposited on the catalyst tend to be concentrated in the high surface area, porous, alumina additive the metals accumulate on the alumina and eventually exit the regenerator with the flue gas in the form of a fine dust which is recovered by an electrostatic precipitator or other means downstream of the regenerator. With repeated cycling of the catalyst and alumina additive, the additive preferably attrits rapidly, so alumina is removed as "fines". Alumina additive is added at a rate sufficient to maintain the required metals-scavenging activity. This makeup rate is determined by the nature of the additive, but will be in a range so as to keep the steady state concentration between 0.1 and 10 weight percent, and preferably between 0.5 and 7.0 weight percent. The net result of the process of this invention is that a portion of the metals introduced by the feed to the cracker is withdrawn from the system, thereby reducing the rate of accumulation of metals on the catalyst. This reduced rate of accumulation extends catalyst life, improves catalyst selectivity for gasoline and fuel oil, and reduces the requirement for makeup catalyst. Alternatively, the refiner may choose to use a heavier feed more contaminated with metals, to realize economic advantage.

CO COMBUSTION PROMOTER

In a preferred embodiment of this invention, the FCC catalyst contains a platinum metal CO-oxidation promoter. Typically 0.1–50 ppm of a Pt group inital is added to the circulating catalyst inventors. This permits some control of the emissions of carbon monoxide from the regenerator while maintaining a generally reducing atmosphere in the regenerator. This keeps the vanadium in a lower state of oxidation so more vanadium can be tolerated on the catalyst and collected on the additive. These conditions will degrade the ability of the alumina to react with or adsorb $SO_x$. Conventional $SO_x$ additives can be added, but will not function as $SO_x$ additives.

CRACKING PROCESS

The invention may be used in FCC and TCC (or moving bed catalyst cracking) procedures, both of which are well known.

ADDITIVE ADDITION

The separate particles of additive, e.g., alumina are introduced into the circulating inventory at any convenient point, such as by adding the particles into the regenerator along with the fresh makeup cracking catalyst. This may be accomplished, for example, in an analogous fashion to the manner in which CO combustion promoter additives or ZSM-5 octane enhancing additives are added. Alternatively, the alumina additive particles may be introduced into the system downstream of the primary combustion zone of the regenerator, for example, by adding them to the regenerated catalyst as it proceeds from the regenerator to the reactor. Finally, the additive particles may be introduced into the system on the reactor side by adding them directly to the FCC hydrocarbon feedstock. In this case, the particles are mixed and dispersed in the feed prior to the point where the feed is sprayed into the base of the reactor to mix with the incoming regenerated cracking catalyst. The additive particles are introduced into the system continuously or at convenient intervals. If introduced at intervals, the intervals should be sufficiently close to maintain the desired amount of alumina in the equilibrium catalyst. The amount of alumina added should provide a steady state concentration of 0.1 to 10.0 wt % based on cracking catalyst in the cracking zone, with a preferred range of about 0.5 to 5.0 weight percent.

The following examples are provided to illustrate the scavenging selectivity for vanadium that alumina have when used under FCC process conditions.

EXAMPLES

Physical mixtures of various porous solids were tested to determine relative affinities for vanadium and coke under simulated FCC cracking conditions (1000° F., 1 LHSV, 700–1000 SCF/B He). By cracking an Arab Light gas oil doped with 0.43 wt. % vanadium as vanadium naphthenate over 50:50 wt. % physical mixtures of two differently sized materials in a dense fluid bed and then separating the particles, we were able to determine the relative amount of vanadium and coke deposited on each material. Table 1 shows that both alumina and sponge coke show an affinity for vanadium up to 200 time higher than a commercial equilibrium catalyst, FS-30. Siliceous materials such as Controlled-Pore Glass, and magnesium oxide all show a lower affinity for the vanadium than the commercial equilibrium FS-30 catalyst.

The commercial regenerator was run at: 1300 F, 3% $O_2$ excess, 10 min. residence time. These conditions are outside the scope of the present invention, in that almost complete combustion of CO is achieved at these conditions. The oxidizing atmosphere will increase the oxidation state of the vanadium, but will not change significantly the partitioning of vanadium between the FCC catalyst and the additive.

TABLE 1

| Metal and Coke Partitioning Data | | | | | | | | |
|---|---|---|---|---|---|---|---|---|
| Catalyst/ | | BET Surface | % Relative | Coke | Vanadium | | Coke | |
| Substrate | Mesh Size | Area ($m^2/g$) | Vanadium* | (wt %) | Kv | Kve | Kc | Kce |
| FS-30 FCC | 140/170 | 117 | 1.9 | 1.30 | 50.8 | 206.0 | 1.5 | 6.2 |
| $Al_2O_3$ | 40/80 | 267 | 98.1 | 2.00 | | | | |
| FS-30 FCC | 140/170 | 117 | 20.3 | 0.92 | 3.9 | 8.9 | 3.1 | 7.0 |
| $Mg_2(SiO_2)_3$ | 40/80 | 569 | 79.7 | 2.86 | | | | |
| FS-30 FCC | 140/170 | 117 | 42.4 | — | 1.4 | 5.1 | — | — |
| Joliet Shot Coke | 40/80 | 5 | 57.6 | — | | | | |
| FS-30 FCC | 140/170 | 117 | 5.4 | — | 17.5 | 48.9 | — | — |
| Joliet Sponge Coke | 60/80 | 5 | 94.6 | — | | | | |
| FS-30 FCC | 140/170 | 117 | 35.0 | 0.005 | 1.9 | 6.6 | 93 | 328.0 |
| $SiO_2$ | 40/80 | 1019 | 65.0 | 0.465 | | | | |
| FS-30 FCC | 140/170 | 117 | 22.2 | 3.31 | 3.5 | 2.5 | 1.1 | 0.8 |
| CPG-A | 200/400 | 204 | 79.8 | 3.57 | | | | |
| FS-30 FCC | 140/170 | 117 | 68.3 | 1.60 | 0.5 | 0.9 | 0.3 | 0.6 |
| CPG-B | 80/100 | 155 | 31.7 | 0.53 | | | | |
| FC-30 FCC | 140/170 | 117 | 12.5 | 2.09 | 7.0 | 13.5 | 0.8 | 1.5 |
| CPG-C | 80/100 | 24 | 87.5 | 1.61 | | | | |
| FS-30 FCC | 140/170 | 177 | 46.4 | 2.33 | 1.1 | 4.0 | 0.5 | 1.7 |
| MgO | 40/80 | 31 | 53.4 | 1.14 | | | | |
| NaY | 150/170 | 847 | 43.9 | 6.42 | 1.3 | 9.5 | 0.2 | 1.6 |
| $Al_2O_3$ | 40/80 | 267 | 56.1 | 1.34 | | | | |
| Nay | 40/80 | 854 | 54.6 | 7.37 | 0.8 | 0.5 | 0.2 | 0.1 |
| $Al_2O_3$ | 150/170 | 267 | 45.4 | 1.75 | | | | |

*Based on 0.01 grams of vanadium introduced into the bed over a 10 minute period. If vanadium was equally distributed between both materials, vanadium loading would be 1000 ppm on all solids (catalyst and substrate).

The relative affinity of the materials for metals has been quantified in terms of partitioning coefficients. The partitioning coefficient Kv or Kc represents ratio of absolute concentration of vanadium or coke on the substrate materials versus that on the cracking catalyst; while Kve and Kce denote the same ratio of concentrations which has been normalized with respect to the external surface area of each component, respectively. Kv and Kve values for the alumina are 50.8 and 206, respectively. The corresponding values for the silica are 1.9 and 66.

In Table 1, the vanadium partitioning data are reported in two ways, Kv and Kve.

Kv is defined as ratio of the absolute concentration of vanadium on substrate/catalyst.

Kve is defined as ratio of the absolute concentration of vanadium normalized with respect to external surface area.

Coke partitioning data are also reported in two ways, Kc and Kce.

Kc is defined as ratio of the absolute concentration of coke on substrate/catalyst.

Kce is defined as ratio of the absolute concentration of coke normalized with respect to external surface area.

Both Kv and Kc are partitioning coefficients calculated based solely on the weight of the different additives or getter materials used. Surface area effects are ignored.

Kve and Kce are calculations reflecting the ratios of surface area available in the additive vs surface area available in the conventional catalyst.

RESULTS AND DISCUSSION

Table 1 shows results of metal and coke partitioning between the series of catalyst and substrate mixtures. The partitioning coefficient K denotes ratio of the absolute concentration of vanadium or coke on the substrate material to that on the catalyst. The subscripts v and c stand for vanadium and coke, respectively. A K value equal to 1 would represent an equal distribution of vanadium or coke between the substrate and the catalyst.

Kve and Kce are the ratios of partitioning coefficients which have been normalized with respect to the external surface area of each component, respectively. A sample calculation of Kve and Kce for the FCC/$Al_2O_3$ mixture is shown below. The amount of vanadium accumulated on the equilibrium FCC catalyst from a commercial unit and the $SiO_2$—$Al_2O_3$ matrices (Table 1) was determined by measuring the difference between the initial and final vanadium contents of the catalysts.

Partitioning Coefficient Calculation FCC Catalyst

Mesh Size: 140/170 (mean diameter=97 microns)
Particle Density: 1.095 g/cc $$\begin{aligned}\text{External surface area/gram sample} &= (\text{volume of sample/gram}) \times (\text{ext. surface area of a particle})\\ &= [(1/p)/(4\,r^3)] \times [4\,r^2]\\ &= 3/pr\\ &= 6/pd\\ &= 6/(1.095\ \text{g/cc})\,(97 \times 10^{-6}\ \text{m}) \times (100\ \text{cm}/_2\text{m})\\ &= 0.056\ \text{m}^2/\text{gram}\end{aligned}$$

Alumina

Mesh Size: 40/80 (d=302.5 microns)
Particle Density: 1.427 g/cc $$\begin{aligned}\text{External surface area} &= 6/(1.427)\,(302.5 \times 10^{-6})\,(10^2\ \text{cm/m})^3\\ &= 0.0139\ \text{m}^2/\text{gm}\end{aligned}$$

In Table 1 the vanadium contents for FCC catalyst and alumina were 5 and 254 ppm respectively. Hence the partitioning coefficient was:

$$\begin{aligned}Kve &= (254/0.0139)/(5/0.056)\\ &= 206\end{aligned}$$

Similarly, for the coke $$\begin{aligned}Kce &= (2/0.0139)/(1.3/0.056)\\ &= 6.2\end{aligned}$$

VANADIUM PARTITIONING

For a dense fluid bed consisting of two components, the selective uptake of vanadium may depend on the size and the density of each of the components, the particle surface area, as well as the surface metal affinities.

In this bench scale fluid bed, the size and density of the particles influence the mixing of the two component system. At a given fluidizing velocity heavier particles tend to remain on the bottom of the bed while more readily fluidizable component remains on the top, leading to the stratification of two materials. The effect of such a non-uniform two-component bed is to mimic two stage demetallation units and allow vanadium to deposit on the first component it sees. At typical FCC conditions (538° C.), thermal reactions alone are sufficient to crack vanadium containing porphyrin or naphthene structures to permit metal deposition. Table 1 shows that the absolute concentration of vanadium is usually higher on larger particles than on the smaller ones. For example, higher vanadium concentrations were observed on the larger particles from both NaY/$Al_2O_3$ and USY/$Al_2O_3$ runs when the mean particle sizes of cracking catalysts and substrates were reversed from 300 to 92 microns and vice versa.

Consequently, in this system, the metal partitioning is a weak function of either the total (BET) or the external surface areas of particles. There is no correlation between the relative metal uptake level and the surface area of substrates, and the particles with higher surface area do not necessarily show higher capacity for the metals.

If practicing the invention now, we would use an alumina additive having a density of about 4 g/cc, a surface area of 100–300 $m^2/g$, an average particle size of about 100–250 microns, and having an average pore size of 100–200 Angstroms.

The FCC regenerator would be operated at high temperature (1250°–1350° F.), but with air addition limited to provide at least 1% (CO in the flue gas).

We would add enough alumina to produce as equilibrium catalyst containing 0.5–7 wt % alumina.

Removal of a large fraction of metals from the feed will extend catalyst life and improve FCC gasoline and alkylate selectivity. This concept will have significant benefits in reducing catalyst make-up requirements in current catalystic cracking units processing heavier crudes, and can be easily adopted in existing FCC units to process high metal and high CCR resids without costly modification.

Addition of CO combustion promoter would be helpful, in allowing some control of the CO/$CO_2$ ratio in the regenerator. It is not essential to add CO combustion promoter. If CO combustion promoter is added the regenerator air supply must be carefully controlled so that excess air is not added to the regenerator.

We claim:

1. In a catalytic cracking process for cracking of hydrocarbons by contacting a hot, regenerated, solid zeolite cracking catalyst with a crackable hydrocarbon feed containing vanadium in a cracking zone; cracking the feed to lighter hydrocarbons while depositing coke and vanadium on the catalyst; disengaging coked catalyst from lighter hydrocarbons; passing coked catalyst to a regenerator zone and contacting coked catalyst with an oxygen containing gas to burn coke from the catalyst and produce hot, regenerated catalyst and flue gas comprising CO and $CO_2$; returning the regenerated catalyst to the cracking zone; the improvement which comprises:

adding to the cracking catalyst about 0.1 to 10 wt. % of separate particles of a solid additive material, which has more affinity for vanadium than the zeolite cracking catalyst; and limiting the flow of oxygen containing gas to the regenerator to maintain at least 1.0 mole % CO in the flue gas.

2. The process of claim 1 wherein the additive is mixed with at least one of fresh makeup catalyst and hydrocarbon feed.

3. The process of claim 1 wherein the additive material is selected from the group consisting of clay, alumina, petroleum cokes, coals, coal chars, coked coals and biomass-derived materials.

4. The process of claim 1 wherein the selectivity, $K_v$, of said particles for vanadium is at least 1.5.

5. The process of claim 1 wherein the selectivity, $K_v$, of said additive particles for vanadium is at least 10.

6. The process of claim 1 wherein the additive has a density greater than the density of the cracking catalyst.

7. The process of claim 1 wherein the additive is softer than the cracking catalyst.

8. The process of claim 1 wherein at least 10 percent per day of the additive is lost through attrition and abrasion to produce additive fines which contain at least an order of magnitude more wt % vanadium than the cracking catalyst.

9. The process of claim 1 wherein the catalytic cracking process is fluidized catalytic cracking (FCC).

10. The process of claim 1 wherein the catalytic cracking process is moving bed catalytic cracking.

11. The process of claim 1 wherein the regenerator flue gas contain at least 5 mole % CO.

12. The process of claim 1 wherein the flue gas contains $SO_X$, as a result of coke combustion alumina is the additive, the regenerator air supply is restricted to create a generally reducing atmosphere in the regenerator, and wherein a majority of $SO_x$ during coke combustion exits with regenerator flue gas.

13. The process of claim 1 wherein a majority of the vanadium content of the feed is deposited on the additive.

14. The process of claim 13 wherein the additive is alumina having a density of 1 to 4 g/cc, a porosity of 0.6–0.8, and wherein the average residence time of the additive in the FCC unit is less than about 1 day, and a majority of the vanadium in the feed is removed with catalyst fines.

15. In a catalytic cracking process for cracking of hydrocarbons by contacting a hot regenerated, solid zeolite cracking catalyst and a crackable hydrocarbon feed containing vanadium in a cracking zone; cracking the feed to lighter hydrocarbons while depositing coke and vanadium on the catalyst; disengaging coked catalyst from lighter hydrocarbons; passing coked catalyst to a regenerator and contacting coked catalyst with an oxygen containing gas to burn coke off the catalyst to produce hot, regenerated catalyst and a flue gas comprising carbon oxides; returning the regenerated catalyst to the cracking zone; the improvement which comprises:

limiting the flow of oxygen containing gas to the regenerator to maintain at least 1.0 mole % CO in the flue gas;

adding 0.1 to 10 wt. % alumina additive having a vanadium selectivity, Kv, of at least 10, based on the total weight of catalyst and additive in the cracking unit; and removing at least 10% per day of the alumina additive from the cracking unit as fines, the fines containing at least an order of magnitude more vanadium than the additive free catalyst in the unit.

16. The process of claim 15 wherein the additive is alumina having a density of 4 g/cc, a surface area of 100–300 $m^2/g$, and wherein the average residence time of the additive in the cracking unit is less than about 1 day.

17. The process of claim 16 wherein a majority of the vanadium content of the feed is removed with the alumina fines.

18. The process of claim 9 wherein a majority of the vanadium content of the feed is removed with the alumina fines.

19. The process of claim 10 wherein a majority of the vanadium content of the feed is removed with the alumina fines.

20. The process of claim 11 wherein a majority of the vanadium content of the feed is removed with the alumina fines.

* * * * *